US005749707A

United States Patent [19]

Nomoto

[11] Patent Number: 5,749,707

[45] Date of Patent: May 12, 1998

[54] WATER PUMPS

[75] Inventor: Yuji Nomoto, Atsugi, Japan

[73] Assignee: Unisia Jecs Corporation, Atsugi, Japan

[21] Appl. No.: 713,352

[22] Filed: Sep. 13, 1996

[30] Foreign Application Priority Data

Sep. 20, 1995 [JP] Japan ..... 7-241041

[51] Int. Cl.[6] ..... F04B 49/00

[52] U.S. Cl. ..... 416/223 B; 416/185; 416/188

[58] Field of Search ..... 415/206; 416/185, 416/186 R, 188, 223 B

[56] References Cited

U.S. PATENT DOCUMENTS

| | | | |
|---|---|---|---|
| 1,946,273 | 2/1934 | Carr | 416/223 B |
| 3,734,650 | 5/1973 | Reisacher et al. | 415/205 |
| 4,108,570 | 8/1978 | Yamabe | 416/186 R |
| 5,478,200 | 12/1995 | Brodersen et al. | 416/186 R |

FOREIGN PATENT DOCUMENTS 3-77096 8/1991 Japan .

OTHER PUBLICATIONS

C. Pfeiderer "Die Kreiselpumpen Füssigkeiten und Gase", Springer–Verlag, 4th ed., pp. 211 and 212, Fig. 123.

B. Eck "Ventilatoren" Springer–Verlag, 5th ed., pp. 99 and 100, Fig. 70.

*Primary Examiner*—Thomas E. Denion

*Attorney, Agent, or Firm*—Foley & Lardner

[57] ABSTRACT

A water pump comprises an impeller including a rotor main body and vanes arranged to protrude from an end face of the rotor main body and disposed radially. Each vane has an inlet portion which faces an inlet port of a housing and has an inner end which is substantially perpendicular to the direction of cooling water flowing from the inlet port to the inner periphery of each vane. The inlet portion of the vane has a circular arc with an inclination angle which is substantially identical to an inflow angle of cooling water.

2 Claims, 3 Drawing Sheets

WATER PUMPS

BACKGROUND OF THE INVENTION

The present invention relates to water pumps for ensuring forced circulation of cooling water, e.g. in water jackets of internal combustion engines for motor vehicles.

One of conventionally proposed water pumps is disclosed, for example, in JP-U 3-77096. In the water pumps, in view of the pump efficiency, the shape of vanes is determined so as not to produce a collision loss with cooling water flowing into the inside of the water pump. Conventionally, the shape of vanes is obtained by simply extending to a point A of its base end a circular arc connecting a point B of its inner end and a point C of its outer end. Specifically, an inclination angle b of the circular arc, i.e. an inlet angle of the vane is given by:

$$\tan b = \frac{60 \cdot v_e}{2 \cdot \pi \cdot r_B \cdot n}$$

where $r_B$ is a radius extending from a center of a rotor main body to the inner end of the vane, $v_e$ is an average flow velocity of cooling water in the vicinity of the inner end of the vane, and n is a revolution of the vane. An inclination angle of a circular arc connecting the point B and the point A is determined to be identical to the inclination angle b obtained by the above formula.

Thus, an inclination angle of an end portion connecting the inner end and the base end does not always correspond to an inflow angle of cooling water, which may produce an occurrence of a pump loss.

It is, therefore, an object of the present invention to provide a water pump which contributes to a reduction in pump loss.

SUMMARY OF THE INVENTION

According to one aspect of the present invention, there is provided a water pump, comprising:

a housing having an end formed with an inlet port for cooling water;

a drive shaft arranged through said housing; and an impeller mounted to said drive shaft at an end thereof, said impeller including a rotor main body and vanes arranged to protrude from an end face of said rotor main body and disposed radially, each vane having an inlet portion which faces said inlet port of said housing and has an inner end, said inner end being substantially perpendicular to the direction of cooling water flowing from said inlet port to the inner periphery of each vane, said inlet portion having a circular arc with an inclination angle which is substantially identical to an inflow angle of cooling water.

Another aspect of the present invention lies in providing an impeller for a water pump having a housing with an inlet port for cooling water, comprising:

a rotor main body; and vanes arranged to protrude from an end face of said rotor main body and disposed radially, each vane having an inlet portion which faces the inlet port of the housing and has an inner end, said inner end being substantially perpendicular to the direction of cooling water flowing from the inlet port to the inner periphery of each vane, said inlet portion having a circular arc with an inclination angle which is substantially identical to an inflow angle of cooling water.

The primary advantage offered by the present invention is that, since the inlet portion of the vane has a circular arc with an inclination angle which is substantially identical to an inflow angle of cooling water, i.e. a collisionless inflow angle, cooling water flowing from the inlet port does not collide with the inlet portion of the vane, obtaining an improvement of the pump efficiency.

The secondary advantage offered by the present invention is that, since the outlet portion of the vane has a circular arc with an inclination angle which is identical to that of the circular arc of the inlet portion of the vane.

DETAILED DESCRIPTION OF THE INVENTION

Figure 1:
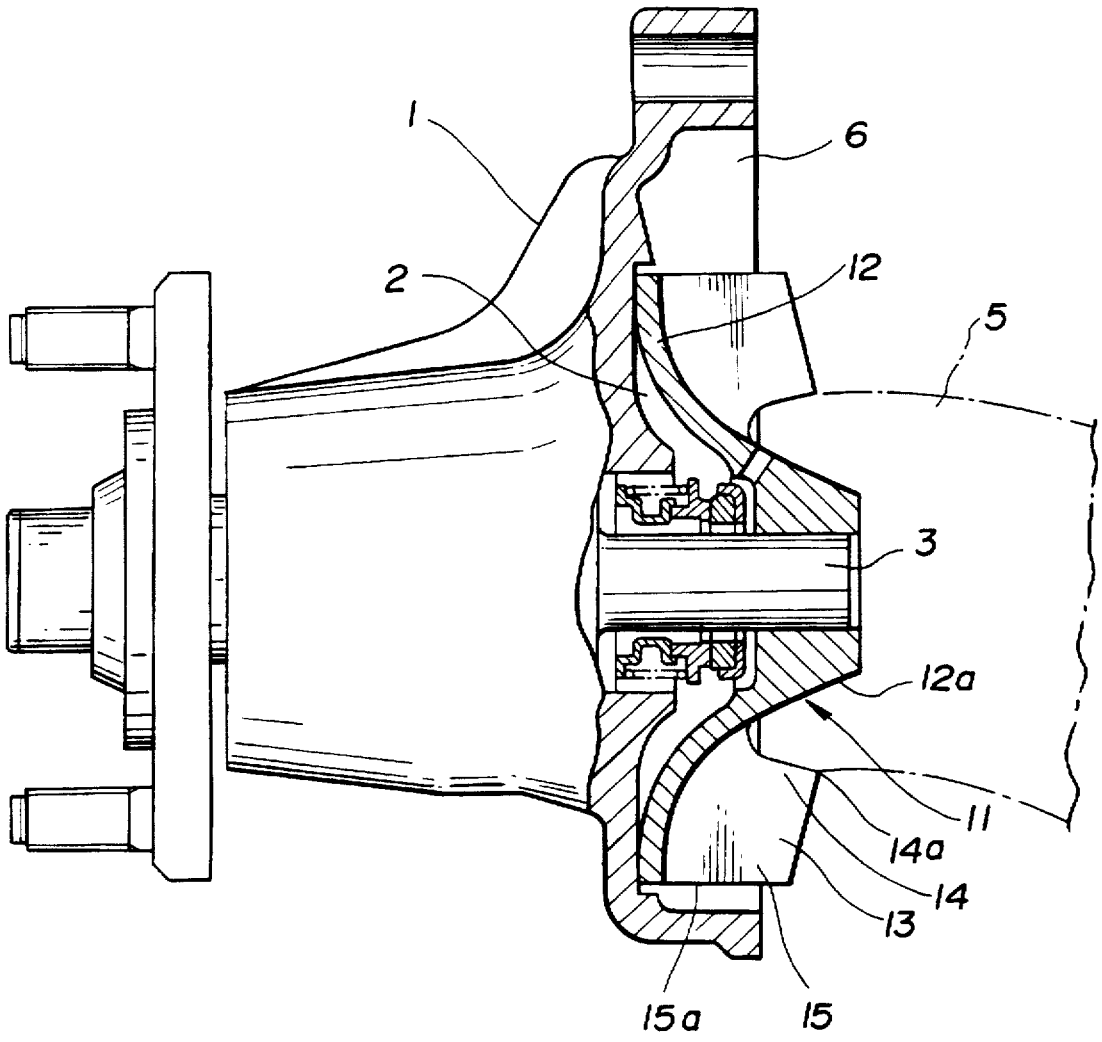
FIG. 1 is a side view, partly broken, showing a water pump to which the present invention is applied.

Referring to the drawings, particularly to FIG. 1, a water pump to which the present invention is applied has substantially the same structure as that of the known water pump as disclosed, e.g. in JP-U 3-77096, comprising a pump housing 1 having a pump chamber 2 therein, a drive shaft 3 rotatably supported to a bearing, not shown, arranged in the pump housing 1 and rotating in synchronism with an engine, not shown, and an impeller 11 mounted to the drive shaft 3 at an end thereof.

A cooling water inlet port 5 is arranged to the pump housing 1 at the front end thereof to make cooling water which has returned from a radiator, not shown, flow to the center of the impeller 11 in the axial direction of the drive shaft 3. On the other hand, a cooling water outlet port 6 is arranged to the impeller 11 at the outer periphery thereof.

The impeller 11 comprises a rotor main body 12 having a center portion **12*a* fixed to the drive shaft 3, and vanes 13 arranged to protrude from a front end face of the rotor main body 12 and disposed radially. Each vane 13 is formed in a circular arc in the inflow direction of cooling water. Thus, when the impeller 11 is rotated by the drive shaft 3, cooling water in the inlet port 5 is forced to flow to the outlet port 6 by means of an inner surface of the vane 13**, obtaining a pump operation.

Figure 2:
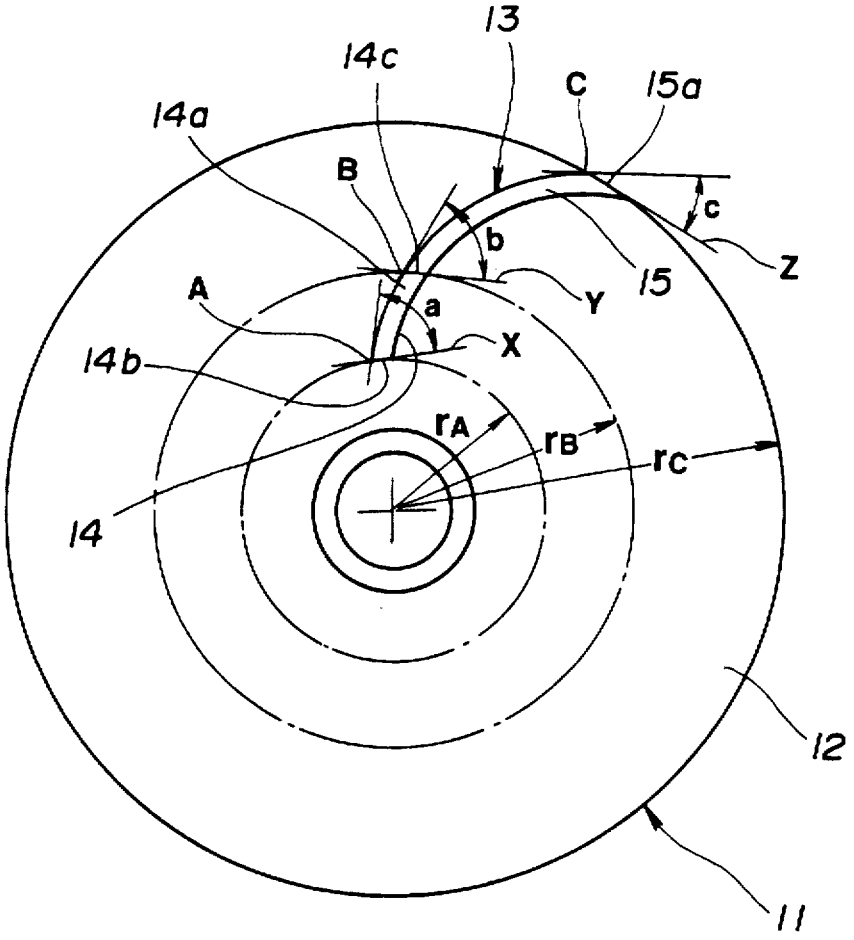
FIG. 2 is a front view showing an impeller of the water pump.
Figure 3:
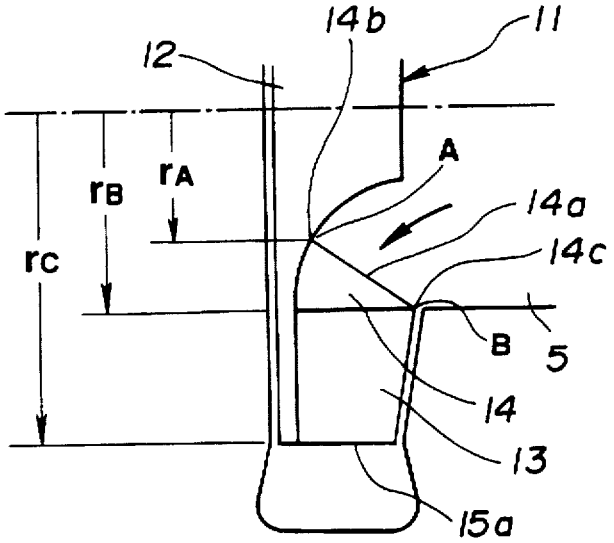
FIG. 3 is an enlarged fragmentary view of FIG. 1.
Figure 4:
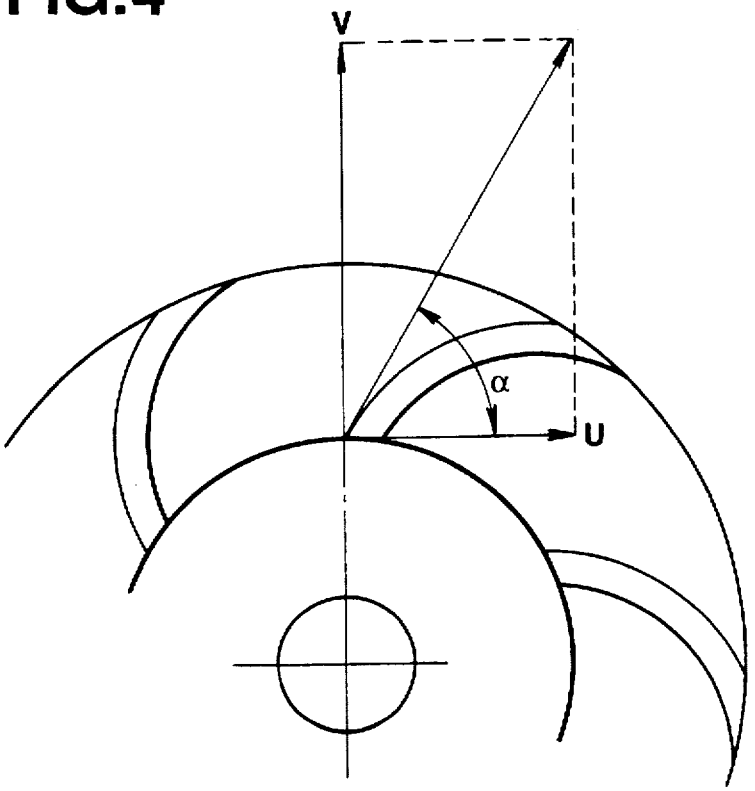
FIG. 4 is a diagrammatic view for explaining the principle of the water pump according to the present invention.

Specifically, referring to FIGS. 2 and 3, each vane 13 is constructed such that an inlet portion 14 facing the inlet port 5 and an outlet portion 15 at the outer periphery of the rotor main body 12 are formed in circular arcs with collisionless inflow angle and same curvature.

As best seen in FIG. 3, the inlet portion 14 has an inner end **14*a* inclining to its outer diameter portion so as to be substantially perpendicular to the direction of cooling water flowing from the inlet port 5 to the vane 13 as indicated by an arrow in FIG. 3. Thus, a point A of an inner peripheral portion 14*b* is positioned on the circumference of a small circle with radius $r_A$, whereas a point B of an outer peripheral portion 14*c* is positioned on the circumference of a middle circle with radius $r_B$. Moreover, the inner peripheral portion 14*b* is formed along a tangential line X of the small circle with radius $r_A$ as shown in FIG. 2, whereas the outer peripheral portion 14*c*** is formed along a tangential line Y of the middle circle with radius $r_B$. That is, referring to FIGS.

2 and 4, an angle a with respect to the tangential line X at the point A is determined to be an angle obtained by tana=V/U where V is a flow velocity of cooling water, and U is a circumferential speed thereof at the point A, i.e. an angle identical to an inflow angle α of cooling water or a collisionless inflow angle. Likewise, an angle b with respect to the tangential line Y at the point B is determined to be a collisionless inflow angle obtained by tanb=V/U.

Referring to FIGS. 2 and 3, the outlet portion 15 has an outer end 15*a* formed in the axial direction of the rotor main body 12. A point C of an outer peripheral portion of the outer end 15*a* is positioned on the circumference of a large circle with radius $r_c$ or the outer periphery of the rotor main body 12. An angle c with respect to a tangential line Z at the point C is determined to be a collisionless inflow angle in the same way as the angle b with respect to the tangential line Y at the point B. The outlet portion 15 has a circular arc which is continuous with a circular arc connecting the point A and the point B, and has the same radius of curvature as that of this circular arc.

A description will be made with regard to formulae for determining a curvature R1 of a circular arc connecting the point A and the point B, and a curvature R of the circular arc connecting the point B and the point C.

First, the radius $r_A$ of the small circle of the vane 13 and the radius $r_B$ of the middle circle thereof are determined as shown in FIG. 2. A circular arc with radius R1 is described on a point Dp1, R1 and Dp1 being obtained by:

$$R1 = \frac{r_A^2 - r_B^2}{2r_A\cos a - 2r_B\cos b}$$

$$Dp1 = 2\sqrt{R^2 + r_B^2 - R \cdot 2r_B \cdot \cos b}$$

Suppose that the radius R1 is a curvature of the circular arc connecting the point A and the point B. Moreover, suppose that the circular arc with radius R1 and the middle circle with radius $r_B$ intersect at a point B, and the circular arc with radius R1 and the small circle with radius $r_A$ intersect at a point A.

Next, a circular arc with radius R is described on a point Dp, R and Dp being obtained by:

$$R = \frac{r_B^2 - r_C^2}{2r_B\cos b - 2r_C\cos c}$$

$$Dp = 2\sqrt{R^2 + r_B^2 - R \cdot 2r_B \cdot \cos b}$$

Suppose that the radius R is a curvature of the circular arc connecting the point B and the point C.

An inlet angle a of the vane 13 formed at an intersection of the circular arc connecting the point B and the point C and the small circle with radius $r_A$ is given by:

$$\tan a = \frac{60 \cdot V_e}{2 \cdot \pi \cdot r_A \cdot n}$$

wherein $v_e$ is an average flow velocity of cooling water in the vicinity of the inner end 14*a* of the vane 13. The inlet angle a obtained by the above formula is greater than the conventional inlet angle b as described hereinbefore, forming a collisionless inflow angle.

Therefore, according to this embodiment, when the impeller 11 is rotated by the drive shaft 3 to make cooling water flow from the inlet port 5 to the impeller 11, cooling water does not collide with the inlet portion 14 of the vane 13 between the point A and the point B. As a result, the water pump has a restrained collision loss with cooling water, resulting in an improvement of the pump efficiency.

Moreover, since the outlet portion 15 between the point B and the point C has a circular arc which is continuous with the circular arc of the inlet portion 14, cooling water is smoothly discharged from the outlet portion 15 to the outlet port 6 along the inner surface of the vane 13 with restrained collision loss, resulting in a further improvement of the pump efficiency.

Having described the present invention in connection with the preferred embodiment, it is noted that the present invention is not limited thereto, and various changes and modifications can be made without departing from the spirit of the present invention.

What is claimed is:

1. A water pump, comprising:

a housing having an end formed with an inlet port for cooling water;

a drive shaft arranged through said housing; and an impeller mounted to said drive shaft at an end thereof, said impeller including a rotor main body and vanes arranged to protrude from an end face of said rotor main body and to be disposed radially, each vane having an inlet portion which faces an inlet port of said housing and has an inner end, said inner end being substantially perpendicular to the direction of cooling water flowing from said inlet port to the inner periphery of each vane, each vane having an outlet portion at the outer periphery of said rotor main body which is formed continuously with respect to said inlet portion and with constant radius of curvature, said inlet portion having a circular arc with an inclination angle which is substantially identical to an inflow angle of cooling water.

2. An impeller for a water pump having a housing with an inlet port for cooling water, comprising:

a rotor main body; and vanes arranged to protrude from an end face of said rotor main body and disposed radially, each vane having an inlet portion which faces the inlet port of the housing and has an inner end, said inner end being substantially perpendicular to the direction of cooling water flowing from the inlet port to the inner periphery of each vane, each vane having an outlet portion at the outer periphery of said rotor main body which is formed continuously with respect to said inlet portion and with a constant radius of curvature, said inlet portion having a circular arc with an inclination angle which is substantially identical to an inflow angle of cooling water.

* * * * *